US005784757A

United States Patent [19]

Cipolla

[11] Patent Number: 5,784,757

[45] Date of Patent: Jul. 28, 1998

[54] VACUUM CLEANER HOSE ASSEMBLY

[75] Inventor: Mark E. Cipolla, Chardon, Ohio

[73] Assignee: Royal Appliance Mfg. Co., Cleveland, Ohio

[21] Appl. No.: 587,860

[22] Filed: Jan. 11, 1996

[51] Int. Cl.[6] ..... A47L 9/24

[52] U.S. Cl. ..... 15/351; 15/383; 285/7

[58] Field of Search ..... 15/347, 350, 351, 15/366, 377, 383; 29/456, 525.01; 285/7, 235, 390, 903

[56] References Cited

U.S. PATENT DOCUMENTS

| | | | |
|---|---|---|---|
| 2,686,962 | 8/1954 | Swann | 29/456 |
| 2,898,622 | 8/1959 | Hurd | 15/350 |
| 2,980,939 | 4/1961 | Sparklin | 15/377 |
| 4,174,858 | 11/1979 | Brooks | 285/7 |
| 5,057,131 | 10/1991 | Lackner et al. | 15/350 |

FOREIGN PATENT DOCUMENTS 772936 4/1957 United Kingdom .

*Primary Examiner*—Terrence Till

[57] ABSTRACT

A vacuum hose assembly includes an air inlet connector, a flexible hose, and rigid tube. Screw threads are provided on one end of the air inlet connector. Screw threads are also provided on one end of the rigid tube. The three components of the hose assembly are coupled by screwing one component to another. Therefore, the air inlet connector is coupled to the flexible hose by screwing the air inlet connector into the flexible hose so that the screw threads of the air inlet connector engage with the ridges of the flexible hose. Furthermore, the rigid tube is coupled to the flexible hose by screwing the rigid tube into the flexible hose so that the screw threads of the rigid tube engage with the ridges of the flexible hose.

16 Claims, 5 Drawing Sheets

FIG. 5
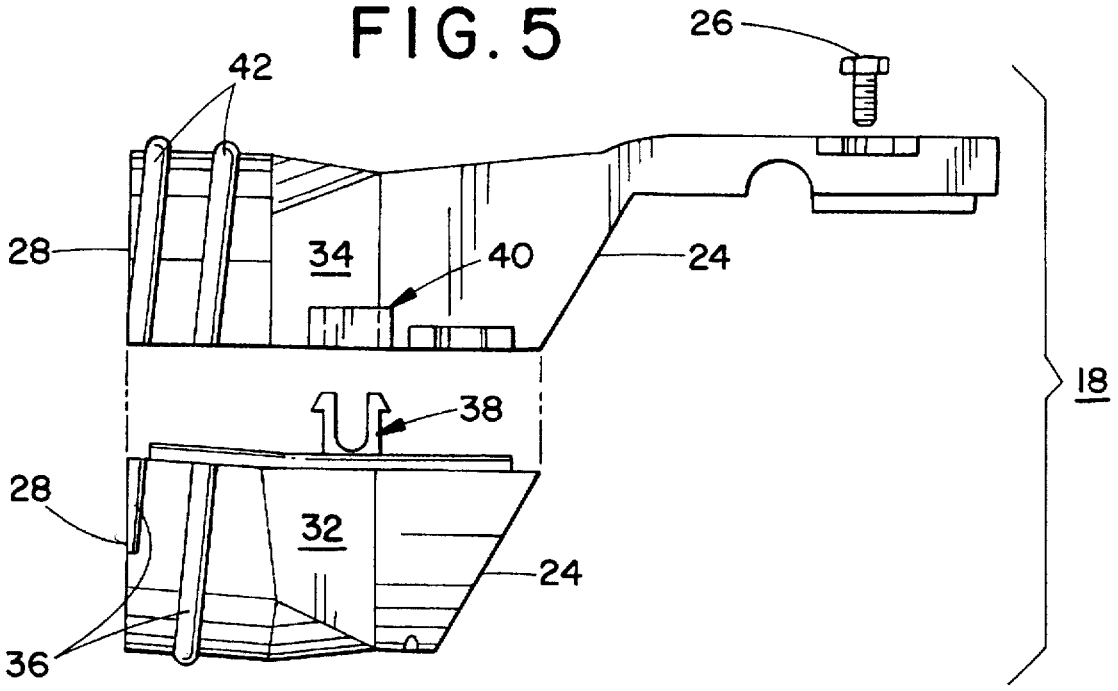
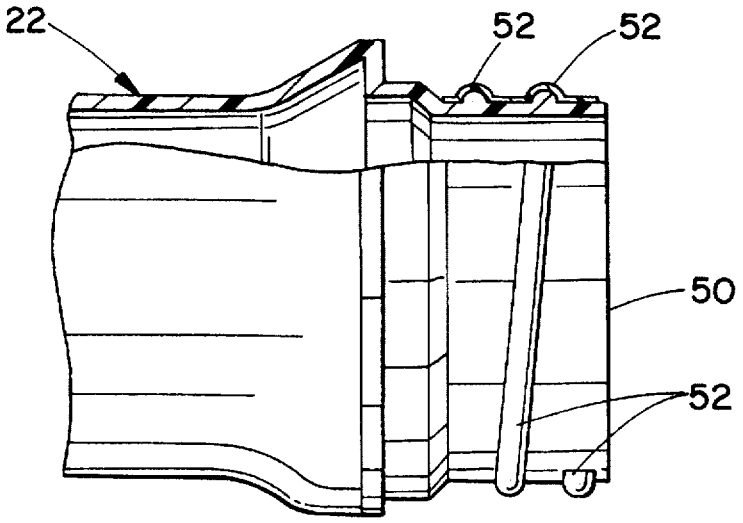
FIG. 6

FIG. 8
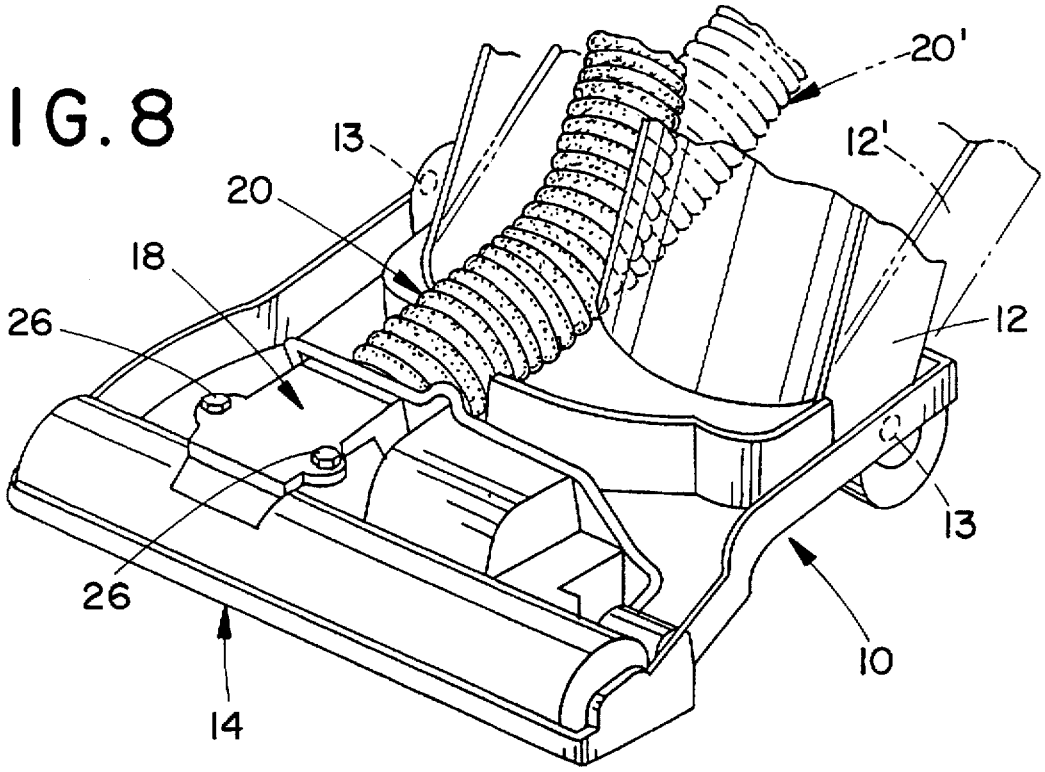
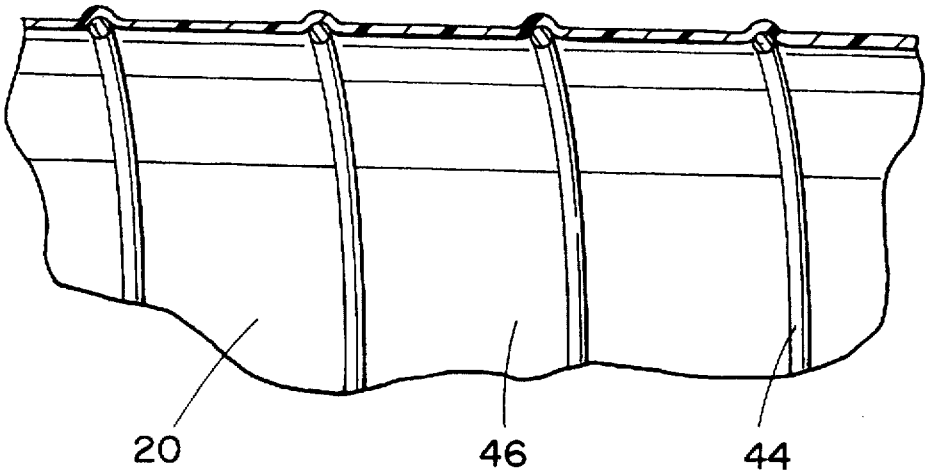
FIG. 9

VACUUM CLEANER HOSE ASSEMBLY

BACKGROUND OF THE INVENTION

This invention relates to a hose assembly for a vacuum cleaner. More particularly, it relates to an improved, simple means for coupling the different components which make up the hose assembly.

The invention is particularly adapted for use with an upright-type vacuum cleaner. However, it should be appreciated by those of average skill in the art that the invention could also be utilized on a variety of other types of vacuum cleaner products.

Vacuum cleaners typically have a hose assembly which must be assembled, usually at the factory. In the past, difficulties have been encountered when connecting these different components. The clamps or fasteners necessary for making the connections were additional components that were costly in the aggregate and time consuming and awkward to install. They sometimes did not hold tight over the life of the vacuum cleaner. Therefore, the hose assembly would become uncoupled and require repairs. Furthermore, if the hose assembly became clogged, decoupling, and later re-coupling, the hose assembly components proved to be a tedious job.

Accordingly, it is desirable to develop a new and improved simple, inexpensive means for coupling the different components of a vacuum cleaner hose assembly to provide better and more advantageous results overall.

SUMMARY OF THE INVENTION

According to the present invention, a new and improved vacuum cleaner hose assembly is provided.

More particularly in accordance with this aspect of the invention, the vacuum cleaner hose assembly comprises an air inlet connector, a flexible hose and a rigid tube. The rigid tube is secured in a main body case of a vacuum cleaner. The air inlet connector is secured to the nozzle body and communicates with a nozzle.

A first end of the air inlet connector is secured to the nozzle body while a second end is secured to the flexible hose. The second end of the air inlet connector has exterior screw threads on its exterior wall. The first end of the flexible hose has interior screw threads on its interior wall. The second end of the air inlet connector is coupled to the first end of the flexible hose by mating the first exterior screw threads of the second end on the air inlet connector with the first interior screw threads of the flexible hose.

A rigid tube is secured in the main body case of the vacuum cleaner and has two ends. The rigid tube is coupled to the flexible hose by mating the second exterior screw threads of the first end of the rigid tube with the second interior screw threads of the second end of the flexible hose. The second end of the rigid tube protrudes into a filter bag.

In accordance with another aspect of the invention, the main body case of the vacuum cleaner is constructed of a rigid thermoplastic material such as ABS.

Preferably, the flexible hose is constructed from a vinyl material and includes a helical rib, between spirals of which is defined a helical groove. In addition, the helical rib is constructed from a metal material.

One advantage of the present invention is the provision of a new and improved vacuum cleaner hose assembly.

Another advantage of the present invention is the provision of a simple, inexpensive means for assembling the vacuum cleaner hose assembly.

Still another advantage of the present invention is the provision of a means for assembling the vacuum hose assembly without the use of clamps.

Another advantage of the present invention is the provision of a vacuum cleaner hose assembly having an air inlet connector which is securely coupled to a flexible hose by mating exterior screw threads of the air inlet connector with screw threads on the interior wall of the first end of the flexible hose. This means of coupling enables the air inlet connector to be easily, inexpensively and securely coupled to the flexible hose. The air inlet connector can be readily decoupled from the flexible hose, and recoupled again, for maintenance should that be necessary.

Still another advantage of the present invention is the provision of a vacuum cleaner hose assembly having a flexible hose with interior screw threads at a second end of an interior wall and a rigid tube which has exterior screw threads at a first end. The flexible hose and rigid tube are coupled together by aligning the exterior screw threads of the rigid tube with the interior screw threads of the flexible hose and rotating the rigid tube to thereby engage the threads of the flexible hose and rigid tube. Such a configuration énables the flexible hose to be easily, and inexpensively coupled with the rigid tube. Furthermore, the configuration allows the flexible hose and rigid tube to be easily decoupled, and recoupled again, for cleaning and maintenance.

Yet another advantage of the present invention is the provision of the flexible hose which allows the main body case of an upright vacuum cleaner to pivot in relation to a nozzle base while maintaining communication between the nozzle base and a filter bag held in the main body case.

Still other benefits and advantages of the invention will become apparent to those skilled in the art upon reading and understanding of the following detailed specification.

BRIEF DESCRIPTION OF THE DRAWINGS

Other objects and attendant advantages of the invention will be apparent from the following description taken in connection with the accompanying drawings in which:

FIG. 5 is an exploded side elevational view of the air inlet connector of FIG. 2;

FIG. 6 is a side elevational view, partially in cross-section, of the rigid tube of FIG. 2;

FIG. 8 is an enlarged perspective view of the electric vacuum cleaner of FIG. 1 illustrating the pivotable connection between the nozzle body and the main body case; and, FIG. 9 is a greatly enlarged partial cross-sectional view of a portion of the flexible hose.

DETAILED DESCRIPTION OF THE PREFERRED EMBODIMENT

Reference will now be made in detail to the present preferred embodiment of the invention, an example of which is illustrated in the accompanying drawings.

While the vacuum cleaner hose assembly will be described in connection with a hard shell upright vacuum cleaner, it will be understood that it is not intended to limit the invention to such vacuum cleaners. On the contrary, the invention could also be used in other types of upright vacuum cleaners as well as canister vacuum cleaners, wet/dry vacuum cleaners, hand-helds and the like.

Figure 1:
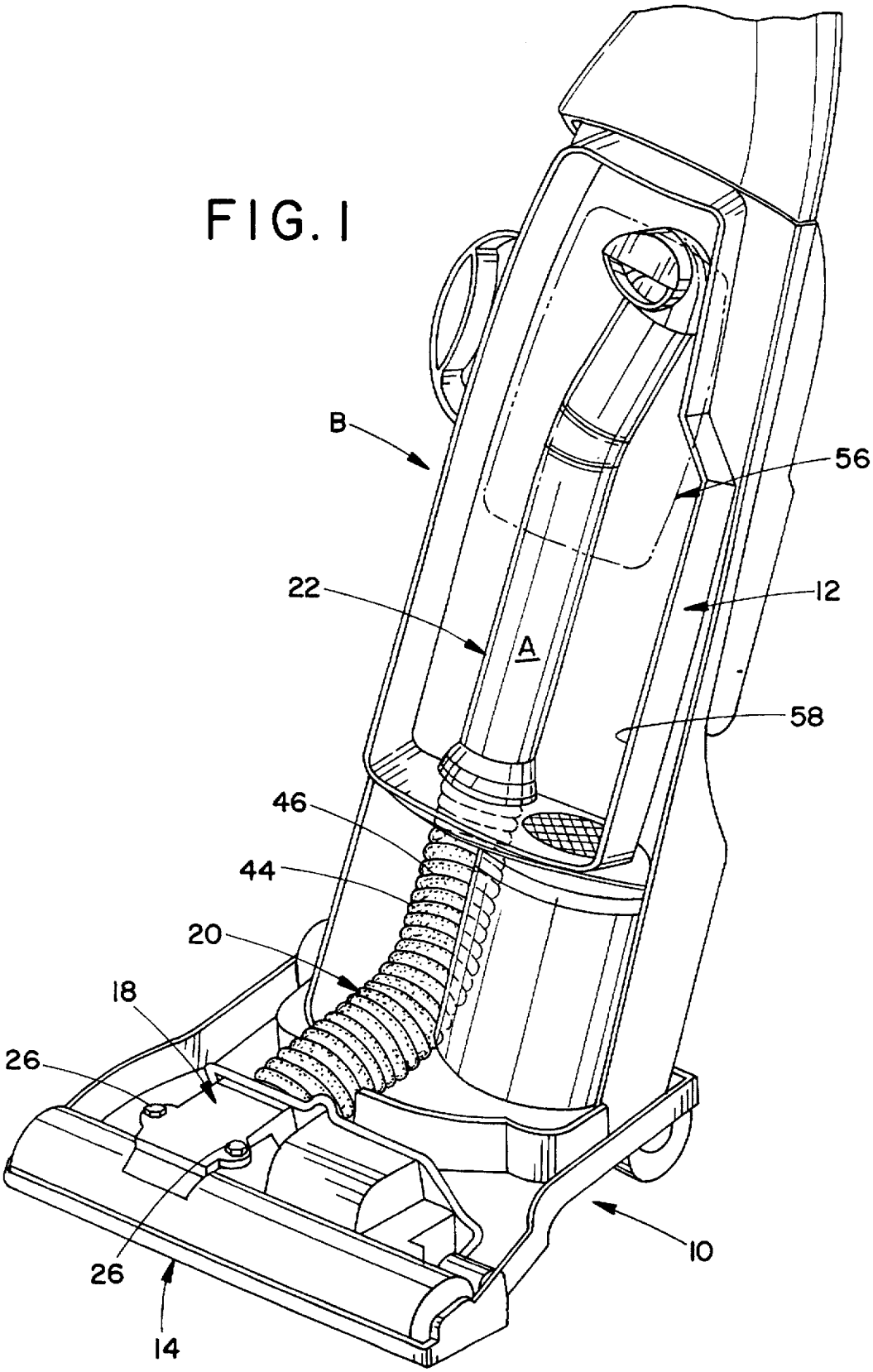
FIG. 1 is a perspective view of a electric vacuum cleaner construction employing the hose assembly according to the present invention.

Referring now to FIG. 1, it may be seen that the vacuum cleaner hose assembly A is contained within a hard shell upright vacuum cleaner B. The vacuum cleaner B has a nozzle body 10, rotatably supported on a subjacent surface, and a main body case 12. As seen by the dashed lines in FIG. 8, the nozzle body 10 and the main body case 12 are secured together around a pivotal connection 13. Components in a reclined position are designated by a primed (') suffix. The nozzle body 10 contains a nozzle 14 in which a brush roll 16 (see FIG. 7) is rotatably mounted. Air and entrained dirt from the floor under the nozzle body 10 are directed the nozzle 14 into the vacuum hose assembly A.

Figure 2:
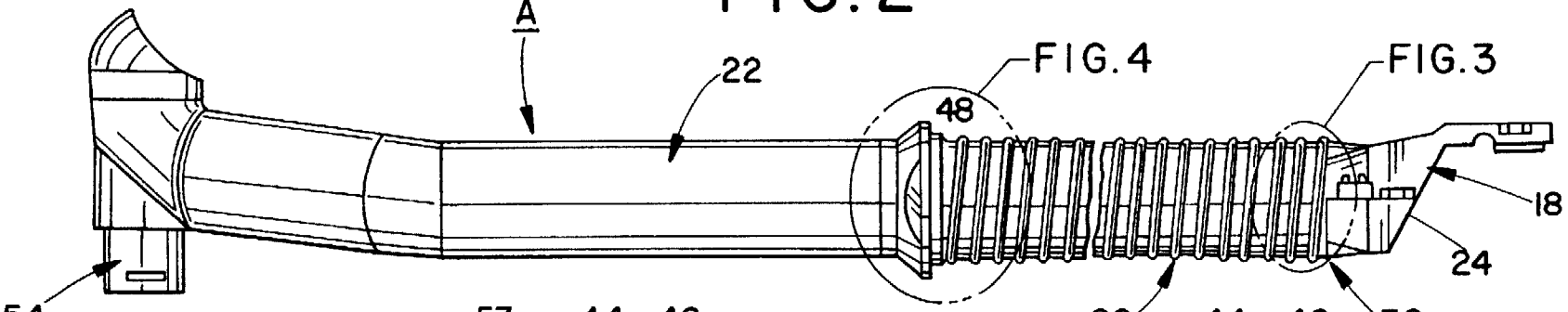
FIG. 2 is a side elevational view of the hose assembly of FIG. 1.

FIG. 2 separately shows an air inlet connector 18, a flexible hose 20, and a rigid tube 22, which comprise the vacuum hose assembly A. The major advantage of the invention rests in the manner in which the three components 18, 20, 22 of the vacuum hose assembly A are coupled together. More specifically, the components 18, 20, 22 screw together, thereby eliminating the need for separate clamps or other fasteners.

FIG. 5 illustrates the rigid air inlet connector 18. The air inlet connector 18 comprises two parts, a bottom part 32 and a top part 34. The bottom part 32 contains threads 36 at an air outlet end 28. It also contains a snap connector 38, with a flanged top edge, for connecting the bottom part 32 to the top part 34. The top part 34 includes a receptacle 40, for receiving the flanged edge of the snap connector 38, and threads 42 at the air outlet end 28. The threads 36, 42 on the bottom and top parts 32, 34, respectively, are molded such that they are aligned with one another when the snap connector 38 is snapped into place inside the receptacle 40. The screw threads 36, 42 then form one continuous, helical screw thread and groove on the outer surface of the rigid air inlet connector 18.

As mentioned, the vacuum hose assembly A includes three components, namely the rigid air inlet connector 18, the flexible hose 20, and the rigid tube 22. The air inlet connector 18 is preferably molded of a suitable conventional plastic or another suitable material. The flexible hose 20 is preferably made from a vinyl material for good compressibility and resilience. The hose 20 also preferably includes a helical rib 44 (see FIG. 7), between the spirals of which is defined a helical groove 46 (see FIG. 7). The helical rib 44 is preferably made from a metal or other suitable material such as plastic. The rigid tube 22 is preferably molded of a thermoplastic such as ABS or another suitable material and (as illustrated in FIG. 2) is a generally cylindrical tube.

Figure 7:
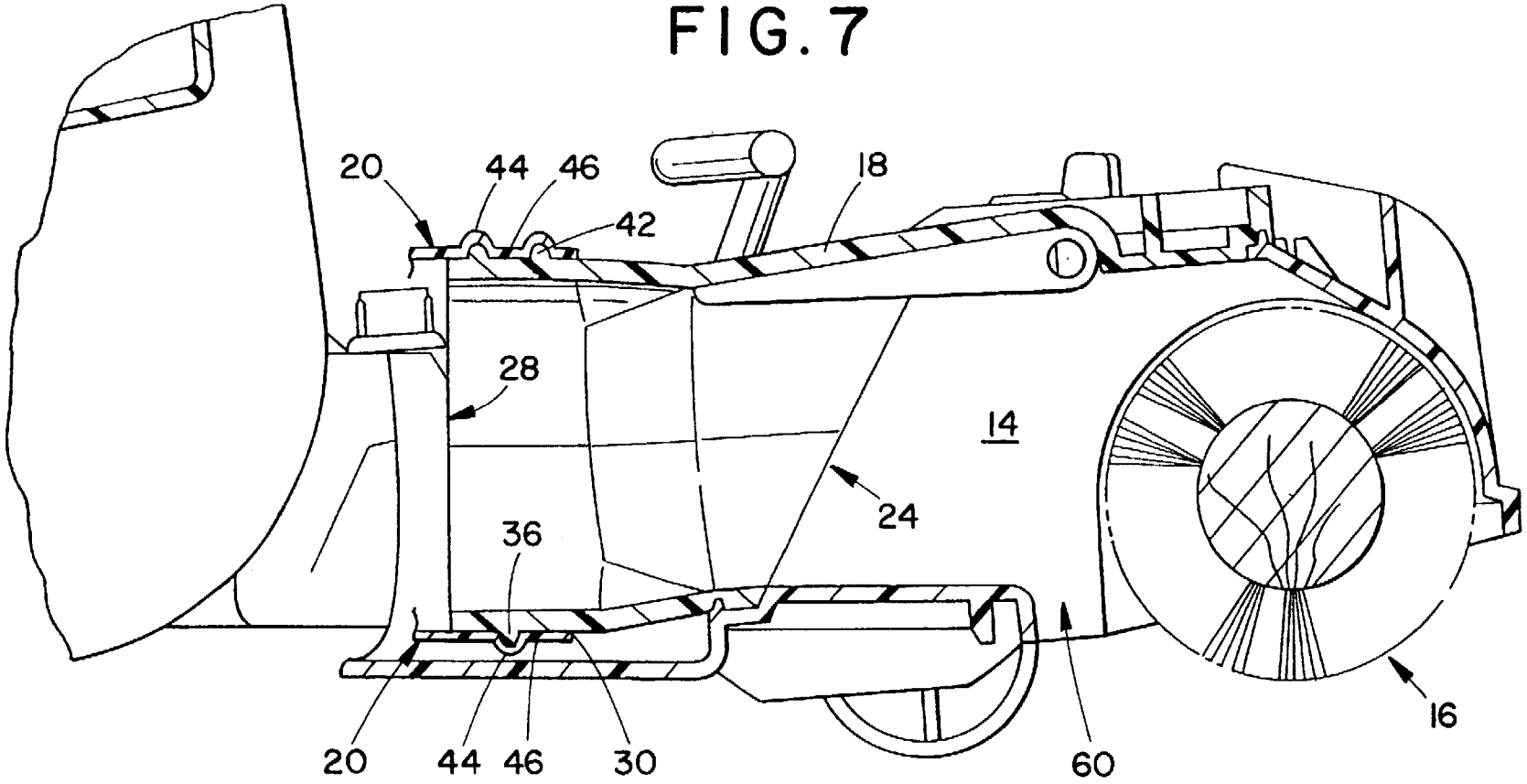
FIG. 7 is a cross-sectional side view of the nozzle and rigid air inlet connector of FIG. 1.

FIG. 7 illustrates a cross-sectional side view of the nozzle 14, the rigid air inlet connector 18, and the flexible hose 20. The brush roll 16 rotates in a clockwise direction thereby directing air and entrained dirt through a nozzle opening 60 and into the nozzle 14. The air and dirt then pass through the nozzle 14 and into the rigid air inlet connector 18. Next, the air and dirt pass through the rigid air inlet connector 18 and into the flexible hose 20. Note that FIG. 7 shows the helical rib 44 and groove 46 in the flexible hose 20. FIG. 7 further illustrates the rib 44 and groove 46 having the same pitch as the threads 36, 42 of the air inlet end 24 of the rigid air inlet connector 18. FIG. 7 also illustrates that the interior diameter of the hose 20 has a size compatible with the exterior diameter of the air inlet connector 18.

Figure 3:
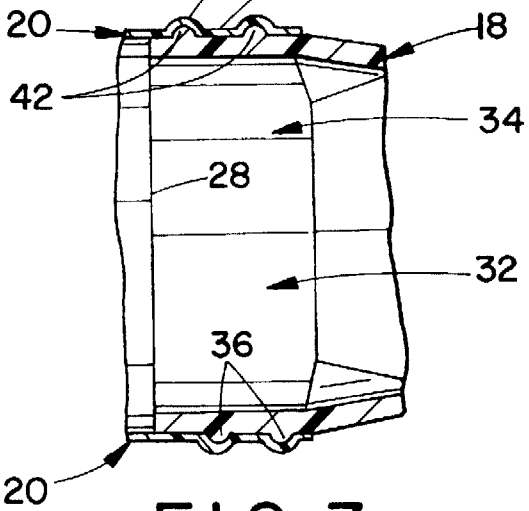
FIG. 3 is a cross-sectional view of an air inlet connector-flexible hose connection of the hose assembly of FIG. 2.

FIGS. 2 and 3 illustrate how the air inlet end 30 of the hose 20 is then secured in the helical groove of the air outlet end 28 of the air inlet connector 18. When assembled, the air inlet connector 18 is secured to the nozzle body 10 by means of a fastener such as a screw 26 (see FIGS. 1 and 5).

Figure 4:
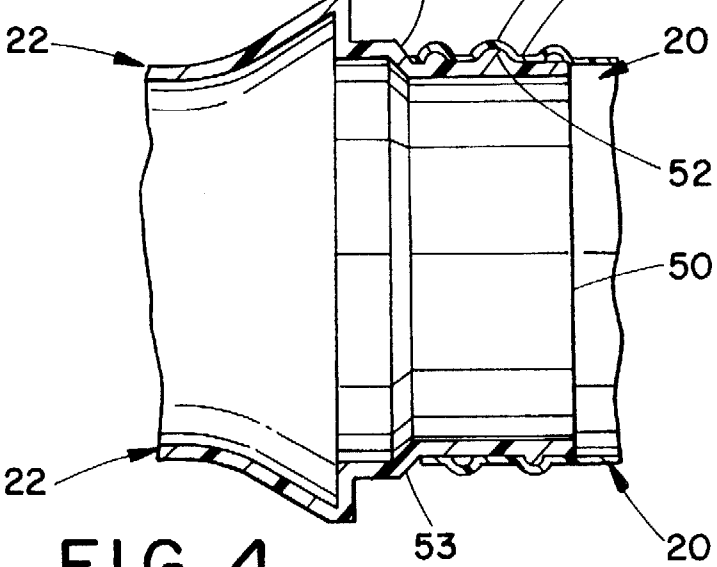
FIG. 4 is a cross-sectional view of a flexible hose—rigid tube connection of the hose assembly of FIG. 2.

FIG. 6 illustrates the rigid tube 22. FIGS. 2 and 4 illustrate how the air outlet end 48 of the flexible hose 20 is in communication with, and coupled to, an air inlet end 50 of the rigid tube 22. The air inlet end 50 of the rigid tube 22 contains a continuous molded helical screw thread 52 (see FIG. 6), having the same pitch as the helical rib 44 and groove 46 of the hose 20, for securing the helical screw thread of the flexible hose 20. Also, the exterior diameter of the tube section containing the screw thread 52 is sized to be compatible with the interior diameter of the hose 20.

FIG. 3 illustrates the connection between the air inlet connector 18 and the flexible hose 20. Note that the screw threads 36, 42 are located on both bottom and top parts 32, 34, respectively, of the air inlet connector 18. These screw threads 36, 42 engage with the helical rib 44 and groove 46 of the flexible hose 20. Therefore, the air inlet connector 18 may be screwed into the flexible hose 20, thereby coupling the two components. Preferably, 1½ threads are defined on the air inlet connector as this number has been found sufficient to form a leak-proof and sturdy connection with the hose 20.

FIG. 4 illustrates the connection between the flexible hose 20 and the rigid tube 22. Note that screw threads 52 on the rigid tube 22 engage with the helical rib 44 and groove 46 of the flexible hose 20. Therefore, the rigid tube 22 may be screwed into the flexible hose 20, thereby coupling the two components together. As illustrated in FIG. 4, a tapered shoulder 53 on the rigid tube 22 contacts an end of the flexible hose 20 illustrated in FIG. 6, preferably 1½ threads are defined on the rigid tube 22 for forming a leak-proof and sturdy connection with the hose 20.

FIGS. 1 and 2 illustrate how an air outlet end 54 of the rigid tube 22 communicates with a filter bag 56. The filter bag 56 is preferably made from a disposable paper material and is secured in a filter chamber 58 defined in the main body case 12. The air outlet end 54 of the rigid tube protrudes into an opening located in the filter bag 56.

Air and entrained dirt, on the floor under the nozzle body 10, enter the vacuum cleaner B through the nozzle 14, pass through the nozzle 14 into the air inlet connector 18, through the air inlet connector 18 to the flexible hose 20, through the flexible hose 20 to the rigid tube 22, and finally through the rigid tube 22 and into the filter bag 56.

Thus it is apparent that there has been provided, in accordance with the invention, a vacuum hose assembly A that fully satisfies the objects, aims, and advantages set forth above. While the invention has been described in conjunction with a preferred embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims or the equivalents thereof.

I claim:

1. A vacuum cleaner comprising:

a nozzle body including a nozzle opening;

a main body case pivotally connected to said nozzle body; and, a hose assembly having a first end connected to said nozzle body and a second end connected to a filter bag, said hose assembly comprising:

an air inlet connector secured to said nozzle body and communicating with said nozzle opening, said air inlet connector comprising:

a first end secured to said nozzle body, and a second end having screw threads on an exterior wall thereof;

a flexible hose having:

first screw threads located on an interior wall thereof at a first end of said flexible hose for coupling said second end of said air inlet connector to said first end of said flexible hose by mating said exterior screw threads of said second end of said air inlet connector with said first screw threads of said first end of said flexible hose, and second screw threads located on said interior wall of said flexible hose at a second end thereof; and a rigid tube secured in said main body case, said rigid tube including:

a first end having screw threads on an exterior wall thereof for coupling said first end of said rigid tube to said second end of said flexible hose by mating said exterior screw threads of said first end of said rigid tube with said interior screw threads on said second end of said flexible hose, the first end of the rigid tube including a tapered shoulder, and a second end located in said main body case.

2. A vacuum cleaner according to claim 1 wherein said main body case comprises a rigid thermoplastic material.

3. A vacuum cleaner according to claim 2 wherein said flexible hose comprises a vinyl material.

4. A vacuum cleaner according to claim 3 wherein said flexible hose includes a helically extending rib and a helical groove defined between adjacent sections of said rib.

5. A vacuum cleaner according to claim 3 wherein said air inlet connector comprises a rigid thermoplastic material.

6. A vacuum cleaner according to claim 5 wherein said rigid tube comprises a rigid thermoplastic material.

7. A vacuum cleaner hose assembly for connecting a nozzle opening and a filter bag, said hose assembly comprising:

an air inlet connector secured to a nozzle body of the vacuum cleaner and communicating with said nozzle opening, said air inlet connector comprising:

a first portion having a snap connector with a flanged top edge, a second portion having a recess sized to fit the flanged top edge of the snap connector, a first end secured to said nozzle body, and a second end having screw threads on an exterior wall of said air inlet connector;

a flexible hose having:

first screw threads located on an interior wall thereof at a first end of said flexible hose for coupling said second end of said air inlet connector to said first end of said flexible hose by mating said exterior screw threads of said second end of said air inlet connector with said first screw threads of said first end of said flexible hose, and second screw threads located on said interior wall of said flexible hose at a second end thereof; and, a rigid tube secured in a main body case, said rigid tube including:

a first end having screw threads on an exterior wall thereof for coupling said first end of said rigid tube to said second end of said flexible hose by mating said exterior screw threads of said first end of said rigid tube with said interior screw threads on said second end of said flexible hose, and a second end secured to the main body case of the vacuum cleaner.

8. A vacuum cleaner according to claim 7 wherein said main body case comprises a rigid thermoplastic material.

9. A vacuum cleaner according to claim 8 wherein said flexible hose comprises a vinyl material.

10. A vacuum cleaner according to claim 9 said flexible hose includes a helically extending rib and a helical groove, said helical groove defined between adjacent sections of said rib.

11. A vacuum cleaner according to claim 10 wherein said air inlet connector comprises a rigid thermoplastic material.

12. A vacuum cleaner according to claim 11 wherein said rigid tube comprises a rigid thermoplastic material.

13. A vacuum cleaner hose assembly according to claim 8 wherein said first portion and said second portion have rib sections, said rib sections cooperating to form said air inlet connector screw threads when said first portion and said second portion are mated.

14. A vacuum cleaner hose assembly for connecting a nozzle opening and a filter bag, the hose assembly comprising:

an air inlet connector secured to a nozzle body of the vacuum cleaner and communicating with the nozzle opening, the air inlet connector having:

a first end secured to the nozzle body, and a second end having screw threads on an exterior wall of the air inlet connector;

a flexible hose comprising a unitary construction of a vinyl material and a helically extending rib defining a helical groove between adjacent sections of the rib, the flexible hose also having:

first screw threads located on an interior wall thereof at a first end of the flexible hose for coupling the second end of the air inlet connector to the first end of the flexible hose by mating the exterior screw threads of the second end of the air inlet connector with the first screw threads of the first end of the flexible hose, and second screw threads located on the interior wall of the flexible hose at a second end thereof; and, a rigid tube secured in a main body case, the main body case including a rigid thermoplastic material, the rigid tube including:

a first end having screw threads on an exterior wall thereof for coupling the first end of the rigid tube to the second end of the flexible hose by mating the exterior screw threads of the first end of the rigid tube with the interior screw threads on the second end of the flexible hose, and a second end secured to the main body case of the vacuum cleaner.

15. A vacuum cleaner according to claim 14 wherein the air inlet connector comprises a rigid thermoplastic material.

16. A vacuum cleaner according to claim 15 wherein the rigid tube comprises a rigid thermoplastic material.

* * * * *